US010504464B2

(12) United States Patent
Zhang et al.

(10) Patent No.: US 10,504,464 B2
(45) Date of Patent: Dec. 10, 2019

(54) DRIVING APPARATUS, DISPLAY APPARATUS WITH OUTPUT ENABLE SIGNAL DRIVING CIRCUIT AND DRIVING METHOD THEREOF

(71) Applicants: BOE TECHNOLOGY GROUP CO., LTD., Beijing (CN); HEFEI XINSHENG OPTOELECTRONICS TECHNOLOGY CO., LTD., Hefei, Anhui (CN)

(72) Inventors: Zhiwei Zhang, Beijing (CN); Tao Ma, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei (CN)

( * ) Notice: Subject to any disclaimer, the term of this patent is extended or adjusted under 35 U.S.C. 154(b) by 140 days.

(21) Appl. No.: 15/234,576

(22) Filed: Aug. 11, 2016

(65) Prior Publication Data

US 2017/0213508 A1 Jul. 27, 2017

(30) Foreign Application Priority Data

Jan. 25, 2016 (CN) ..... 2016 1 0046863

(51) Int. Cl.
*G09G 3/36* (2006.01)

(52) U.S. Cl.
CPC ..... *G09G 3/3614* (2013.01); *G09G 3/3648* (2013.01); *G09G 2300/04* (2013.01); *G09G 2310/08* (2013.01)

(58) Field of Classification Search
CPC ..... G09G 3/3614; G09G 3/3648; G09G 2310/08; G09G 2300/04
See application file for complete search history.

(56) References Cited

U.S. PATENT DOCUMENTS

2001/0043178 A1* 11/2001 Okuzono ..... G09G 3/3614 345/87
2011/0234655 A1* 9/2011 Tzeng ..... G09G 3/3677 345/698

(Continued)

FOREIGN PATENT DOCUMENTS

CN 101191924 A 6/2008
CN 101320552 A 12/2008

(Continued)

OTHER PUBLICATIONS

China First Office Action, Application No. 2016100468631, dated Jul. 3, 2017, 26 pgs.: with English translation.

*Primary Examiner* — Kwang-Su Yang
(74) *Attorney, Agent, or Firm* — Armstrong Teasdale LLP

(57) ABSTRACT

A driving apparatus is provided, including a gate driving circuit, which is connected to each of gate lines, configured to input a gate driving signal to gate lines during each scan cycle, a source driving circuit, which is configured to input a data signal to data lines during each scan cycle and invert the polarities of the data signal to a data line every preset number of scan cycles, and a output enable signal driving circuit, which is configured to input a voltage signal having a first duration to a output enable signal line in response to the polarities of the data signal being inverted during a first scan cycle, and input a voltage signal having a second duration longer than the first duration to the output enable signal line in response to the polarities of the data signal not being inverted during a second scan cycle.

20 Claims, 7 Drawing Sheets

(56) References Cited

U.S. PATENT DOCUMENTS

| | | | | |
|---|---|---|---|---|
| 2011/0298778 | A1* | 12/2011 | Chiang | G09G 3/3648 345/212 |
| 2014/0159798 | A1* | 6/2014 | Duan | G09G 3/3611 327/434 |
| 2014/0176407 | A1* | 6/2014 | Choi | G09G 3/3648 345/87 |

FOREIGN PATENT DOCUMENTS

| | | | |
|---|---|---|---|
| CN | 104361877 | A | 2/2015 |
| JP | 2005156661 | A | 6/2005 |
| JP | 2006047981 | A | 2/2006 |

* cited by examiner

Truth table of gate-level logic circuit

| input end | | output end |
|---|---|---|
| A | B | L |
| 0 | 0 | 0 |
| 0 | 1 | 1 |
| 1 | 0 | 1 |
| 1 | 1 | 0 |

DRIVING APPARATUS, DISPLAY APPARATUS WITH OUTPUT ENABLE SIGNAL DRIVING CIRCUIT AND DRIVING METHOD THEREOF

CROSS REFERENCE TO RELATED APPLICATION

This application claims the benefit and priority of Chinese Patent Application No. 201610046863.1 filed on Jan. 25, 2016, the entire content of which is incorporated herein by reference.

BACKGROUND

The disclosure relates to the technical field of display and in particular relates to a driving apparatus, display apparatus and driving method.

With continuous development of the flat-panel display technology, more and more display apparatus are designed with a dual-gate (Dual Gate) structure in order to, for example, reduce the production cost. With the dual-gate design, as shown in FIG. 1, the number of gate lines doubles, while the number of data lines reduces by half. In each row of pixel units, the odd columns of pixel units are connected to the same gate line and the even rows of pixel units are connected to another adjacent gate line. In particular, as shown in FIG. 2, the data is written in a Z-pattern during the display driving process. Specifically, during a first scan cycle, the gate line GO1 is at a high level, the thin film transistors of the odd columns of pixel units in the first row of pixel units are turned on and the data line receives a data signal to charge the odd columns of pixel units in the first row of pixel units; during a second scan cycle, the gate line GO2 is at a high level, the thin film transistors of the even columns of pixel units in the first row of pixel units are turned on and the data line receives a data signal to charge the even columns of pixel units in the first row of pixel units. Similarly, the gate lines GO3, GO4, . . . , and GO10 are sequentially at a high level and cooperate with the data line to charge the corresponding pixel units.

To avoid damage to the liquid crystal molecules caused by driving the liquid crystal molecules always using the positive voltage or negative voltage, it has been proposed in the prior art to drive the liquid crystal molecules by using the positive and negative voltages alternately. In other words, the polarities of the data signal on the same data line inverted after multiple scan cycles. The source driving circuit 32 needs a period of rising delay time (Rising Time) to output the data signal when the polarity inversion of the data signal occurs. As a result, the data writing time of the pixel units when the polarity inversion of the data signal occurs is shorter than that of the pixel units when the polarity inversion of the data signal does not occur. Accordingly, certain columns of pixel units are charged for relatively longer time while other columns of pixel units are charged for relatively shorter time. As shown in FIG. 2, with the '2Line' polarity inversion mode as an example, the voltage at which the SO1 writes to the R(GO1) has not reached a steady state yet when the gate line GO1 is at a high level; similarly, the voltage at which the SO1 writes the R(G03) has not reached a steady state yet when the gate line GO3 is at a high level, and so on; while the voltage at which the SO1 writes G(G02), G(G04), G(G06) . . . has already reached a steady state. As a result, V-line phenomenon occurs, i.e., the left and right pixel units are of uneven brightness, e.g., one pixel unit is relatively darker while the other is relatively brighter. Therefore, it has become a research focus as to how to achieve even brightness and avoid V-line phenomenon caused by uneven brightness of the pixel units.

BRIEF DESCRIPTION

To solve the above mentioned problems in the prior art, the embodiments of the disclosure propose a driving device, display device and driving method, as discussed hereunder.

According to a first aspect of the disclosure, there is provided a driving apparatus including a gate driving circuit, a source driving circuit and an output enable signal driving circuit, in which the gate driving circuit, which is connected to each of gate lines, is configured to input a gate driving signal to one of the gate lines during each scan cycle, the source driving circuit, which is connected to each of data lines, is configured to input a data signal to each of data lines during each scan cycle and invert the polarities of the data signal input to the same data line every preset number of scan cycles, and the output enable signal driving circuit, which is connected to an output enable signal line, is configured to input a voltage signal having a first duration to the output enable signal line in response to the condition that the polarities of the data signal are inverted during a first scan cycle, and input a voltage signal having a second duration longer than the first duration to the output enable signal line in response to the condition that the polarities of the data signal are not inverted during a second scan cycle, the sum of the first duration and turn-on duration of a first gate line which is turned on during the first scan cycle substantially matches the sum of the second duration and turn-on duration of a second gate line which is turned on during the second scan cycle, the first and second gate lines being any two gate lines in the dual-gate structure.

Optionally, the output enable signal driving circuit includes a first input end, a second input end, a first voltage signal line, a second voltage signal line and an output end.

The output enable signal driving circuit is further configured to output the voltage of the first voltage signal line at the output end when both the voltage input at the first input end and the voltage input at the second input end are either a high level voltage or a low level voltage, and output the voltage of the second voltage signal line at the output end when one of the voltage input at the first input end and the voltage input at the second input end is a low level voltage while the other is a high level voltage.

Optionally, the time difference between the second duration and the first duration substantially matches the rising delay time when the polarities of the data signal are inverted.

Optionally, the preset number of scan cycles is 2.

Optionally, the rising edge of the voltage input at the first input end is aligned with that the voltage input at the second input end.

Optionally, the frequency of the voltage input at the first input end is two times of that of the voltage input at the second input end.

Optionally, the pulse width of the voltage input at the second input end is identical with that of the rising delay time when the polarities of the data signal are inverted.

Optionally, the output enable signal driving circuit includes a first transistor, a second transistor, a third transistor, a fourth transistor, a fifth transistor, a sixth transistor, a seventh transistor, an eighth transistor, a ninth transistor, and a tenth transistor. The first, second, fifth, eighth and ninth transistors are P-type transistor. The third, fourth, sixth, seventh and tenth transistors are P-type transistor.

Optionally, a first end of the first transistor is connected to the first voltage signal line, a second end of the first transistor is connected to a first end of the second transistor, and a control end of the first transistor is connected to the second input end. A second end of the second transistor is connected to a first end of the third transistor and a first end of the fourth transistor, respectively, and a control end of the second transistor is connected to the first input end. A first end of the fifth transistor is connected to the first voltage signal line, a second end of the fifth transistor is connected to a second end of the eighth transistor and a first end of the ninth transistor, respectively, and a control end of the fifth transistor is connected to the second input end. A first end of the eighth transistor is connected to the first voltage signal line, a second end of the eighth transistor is connected to a first end of the ninth transistor, and a control end of the eighth transistor is connected to the first input end. A second end of the ninth transistor is connected to the output end, and a control end of the ninth transistor is connected to a control end of the tenth transistor.

Optionally, a second end of the third transistor is connected to the second voltage signal line, and a control end of the third transistor is connected to the second input end. A second end of the fourth transistor is connected to the second voltage signal line, and a control end of the fourth transistor is connected to the first input end. A first end of the sixth transistor is connected to the output end, a second end of the sixth transistor is connected to a first end of the seventh transistor, and a control end of the sixth transistor is connected to the first input end. A second end of the seventh transistor is connected to the second voltage signal line, and a control end of the seventh transistor is connected to the second input end. A first end of the tenth transistor is connected to the output end, a second end of the tenth transistor is connected to the second voltage signal line, and a control end of the tenth transistor is connected to a second end of the second end of the second transistor.

Optionally, the output end is connected to the output enable signal line.

According to a second aspect of the disclosure, there is provided a display apparatus including the driving apparatus described above.

According to a third aspect of the disclosure, there is provided a driving method for use in the driving apparatus described above, the method including a source driving circuit inputting a gate driving signal to each of gate lines during each scan cycle, a source driving circuit inputting a data signal to each of data lines during each scan cycle and inverting the polarities of the data signal input to the same data line every preset number of scan cycles, and inputting a voltage signal having a first duration to the output enable signal line in response to the condition that the polarities of the data signal are inverted during a first scan cycle, and inputting a voltage signal having a second duration longer than the first duration to the output enable signal line in response to the condition that the polarities of the data signal are not inverted during a second scan cycle, the sum of the first duration and turn-on duration of a first gate line which is turned on during the first scan cycle substantially matches the sum of the second duration and turn-on duration of a second gate line which is turned on during the second scan cycle, the first and second gate lines being any two gate lines in the dual-gate structure.

Optionally, the difference between the second duration and the first duration is the rising delay time when the polarities of the data signal are inverted.

Optionally, the preset number of scan cycles is 2.

According to embodiments of the disclosure, inputting a voltage signal having a first duration to the output enable signal line if the polarities of the data signal are inverted during a first scan cycle, and inputting a voltage signal having a second duration longer than the first duration to the output enable signal line if the polarities of the data signal are not inverted during a second scan cycle, results in the turn-on duration of the corresponding gate lines being adjusted when the polarities of the data signal are inverted. As a result, the charging time of the pixel units when the polarities of the data signal are inverted substantially matches the charging time of the pixel units when the polarities of the data signal are not inverted, avoiding the occurrence of V-line phenomenon and ensuring even brightness of both the left and right pixel units.

BRIEF DESCRIPTION OF THE DRAWINGS

To make the disclosure more clear, the accompanying drawings for illustrating the embodiments of the disclosure are outlined below. Evidently, the accompanying drawings are exemplary only, and those skilled in the art can derive other embodiments from such accompanying drawings without creative efforts.

DETAILED DESCRIPTION

The disclosure will become apparent through the embodiments of the disclosure that are described in details with reference to the drawings.

Figure 1:
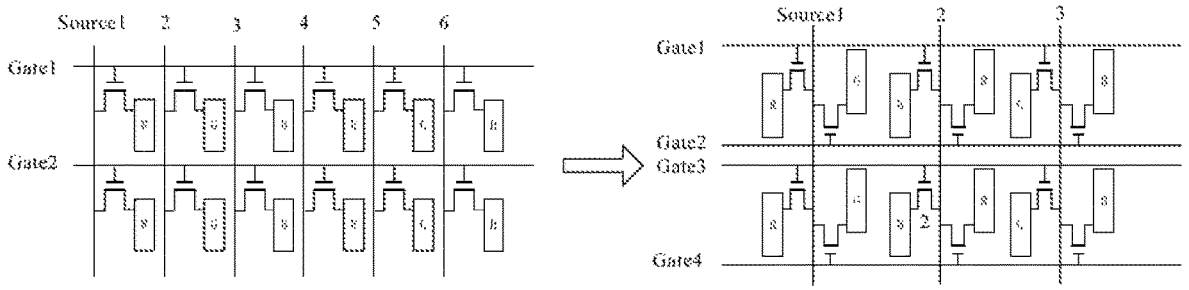
Fig. 1 (PRIOR ART)
FIG. 1 is a schematic view illustrating a dual-gate design according to the prior art.
Figure 2:
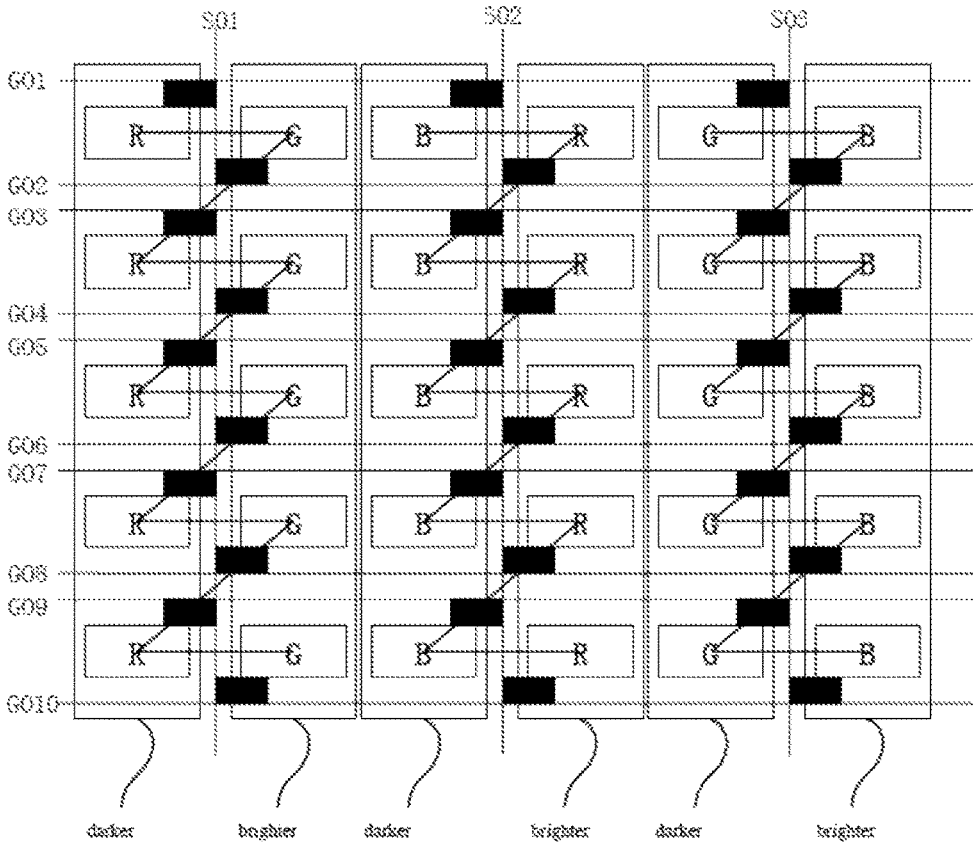
Fig. 2 (PRIOR ART)
FIG. 2 is a schematic view illustrating the brightness of a pixel unit according to the prior art.
Figure 3:
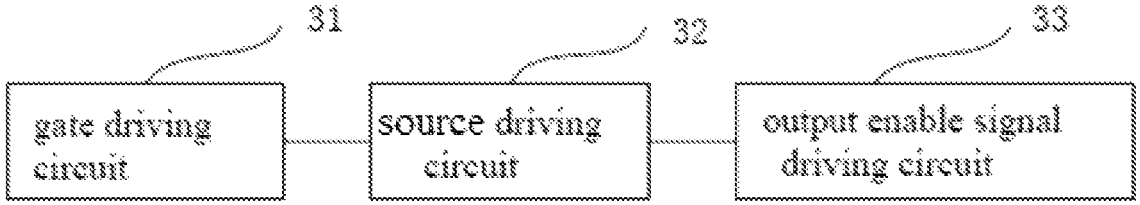
FIG. 3 is a schematic view illustrating the structure of a driving apparatus according to an embodiment of the disclosure.

FIG. 3 is a schematic view illustrating the structure of a driving apparatus according to an embodiment of the disclosure. As shown in FIG. 3, the apparatus includes a gate driving circuit 31, a source driving circuit 32 and an output enable signal driving circuit 33.

The gate driving circuit 31, which is connected to each of gate lines, is configured to input a gate driving signal to one of the gate lines during each scan cycle.

The source driving circuit 32, which is connected to each of data lines, is configured to input a data signal to each of data lines during each scan cycle and invert the polarities of the data signal input to the same data line every preset number of scan cycles.

The output enable signal driving circuit 33, which is connected to an output enable signal line, is configured to input a voltage signal having a first duration to the output enable signal line in response to the condition that the polarities of the data signal are inverted during a first scan cycle, and input a voltage signal having a second duration longer than the first duration to the output enable signal line in response to the condition that the polarities of the data signal are not inverted during a second scan cycle, the sum of the first duration and turn-on duration of a first gate line which is turned on during the first scan cycle is equal to or substantially matches the sum of the second duration and turn-on duration of a second gate line which is turned on during the second scan cycle, the first and second gate lines being any two gate lines in the dual-gate structure.

In particular, the output enable signal (Gate Driver Output Enable) line may be an output enable signal line of the TFT switch. Here we take a 15.6 FHD (Full High Definition) display panel with dual-gate design as an example, it is characterized by a pixel matrix of 1920×1080 pixels, a refresh rate of 60 Hz, Hor Total=Hor Active+Hor Blanking=2120, and Ver Total=Ver Active+Ver Blanking=1100. Therefore, the theoretical charging time of each row of the pixel units is T=7.64 μs.

Figure 4:
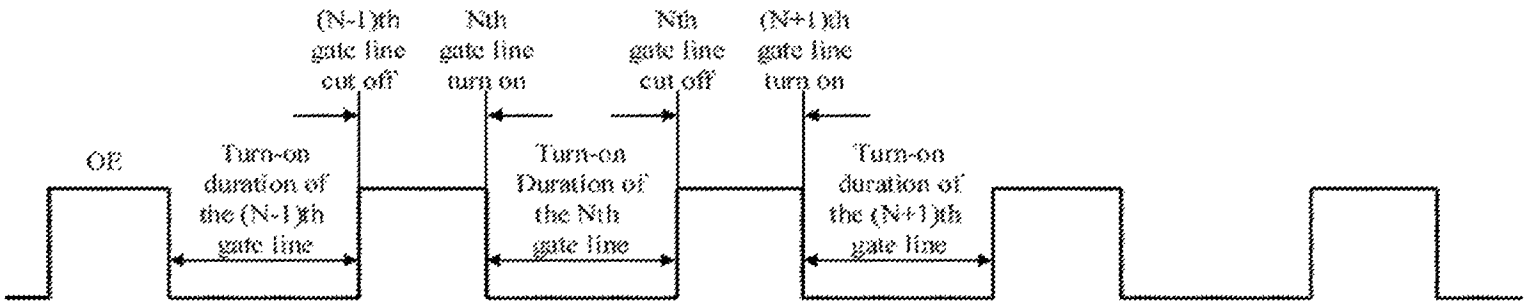
FIG. 4 is a schematic view illustrating the sequence diagram of a circuit according to an embodiment of the disclosure.

As shown in FIG. 4, according to the existing display panel driving process, the previous gate line is switched off at the rising edge of the output enable signal and the next gate line is turned on at the falling edge of the output enable signal. During turn-on duration of the gate line, the corresponding pixel units are charged by the data line. The pulse width of the output enable signal is a time interval between the time at which the previous gate line is switched off and the time at which the next gate line is turned on. The output enable signals having the same pulse width ensures that the charging time is equal for each row of the pixel units.

In order to protect the liquid crystal molecules, the polarities of the data signal input from the data line are inverted every two rows of pixel units in the embodiments of the disclosure. In other words, the embodiments of the disclosure adopt a '2Line' inversion mode. Moreover, the polarity inversion of the data signal always occurs in the odd rows. The source driving circuit 32 needs a period of rising delay time (Rising Time) when the polarity inversion of the data signal occurs. Actual measurements show that the 15.6 FHD display has a rising delay time of 780 ns. Because of the polarity inversion of the data signal and because the inversion always takes places in the odd rows, the actual charging time of the odd rows of pixel units is shorter than that of the even rows of pixel units by 780 ns. As a result, the V-line phenomenon occurs.

Figure 5:
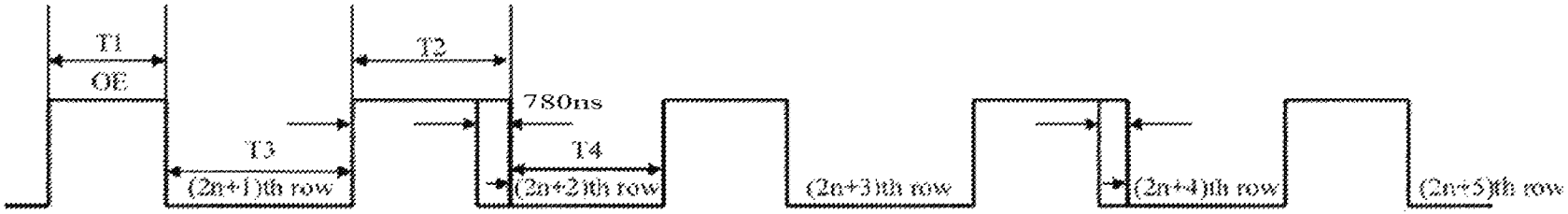
FIG. 5 is a schematic view illustrating the sequence diagram of a circuit according to an embodiment of the disclosure.

To avoid the V-line phenomenon, the embodiments of the disclosure adjust the pulse width of the output enable signal corresponding to the odd rows of pixel units such that the falling edge of the output enable signal corresponding to the even rows of pixel units is delayed by 780 ns, as shown in FIG. 5. Only at the falling edge of the output enable signal can the next gate line be turned on to charge the corresponding pixel units, as a result, the charging time of the even rows of pixel units is also reduced by 780 ns. To adjust the pulse width of the output enable signal corresponding to the odd rows of pixel units, the embodiments of the disclosure input a voltage signal having a first duration to the output enable signal line at the odd rows where the polarity inversion occurs, and input a voltage signal having a second duration to the output enable signal line at the even rows where the polarity inversion do not occur. The second duration is longer than the first duration. Referring to FIG. 5, T1 represents the first duration, T2 represents the second duration, T3 represents the turn-on duration of the (2n+1)th gate line, T4 represents the turn-on duration of the (2n+2)th gate line, in this case, T1+T3=T2+T4. The (2n+1)th gate line and the (2n+2)th gate line are any two gate lines in the dual-gate structure. The (2n+1)th gate line is turned on during the (2n+1)th scan cycle and the (2n+2)th gate line is turned on during the (2n+2)th scan cycle. The duration of the voltage signal outputted by the output enable signal line is controlled by the output enable signal driving circuit 33 the structure of which is detailed below.

Figures 6A, 6B:
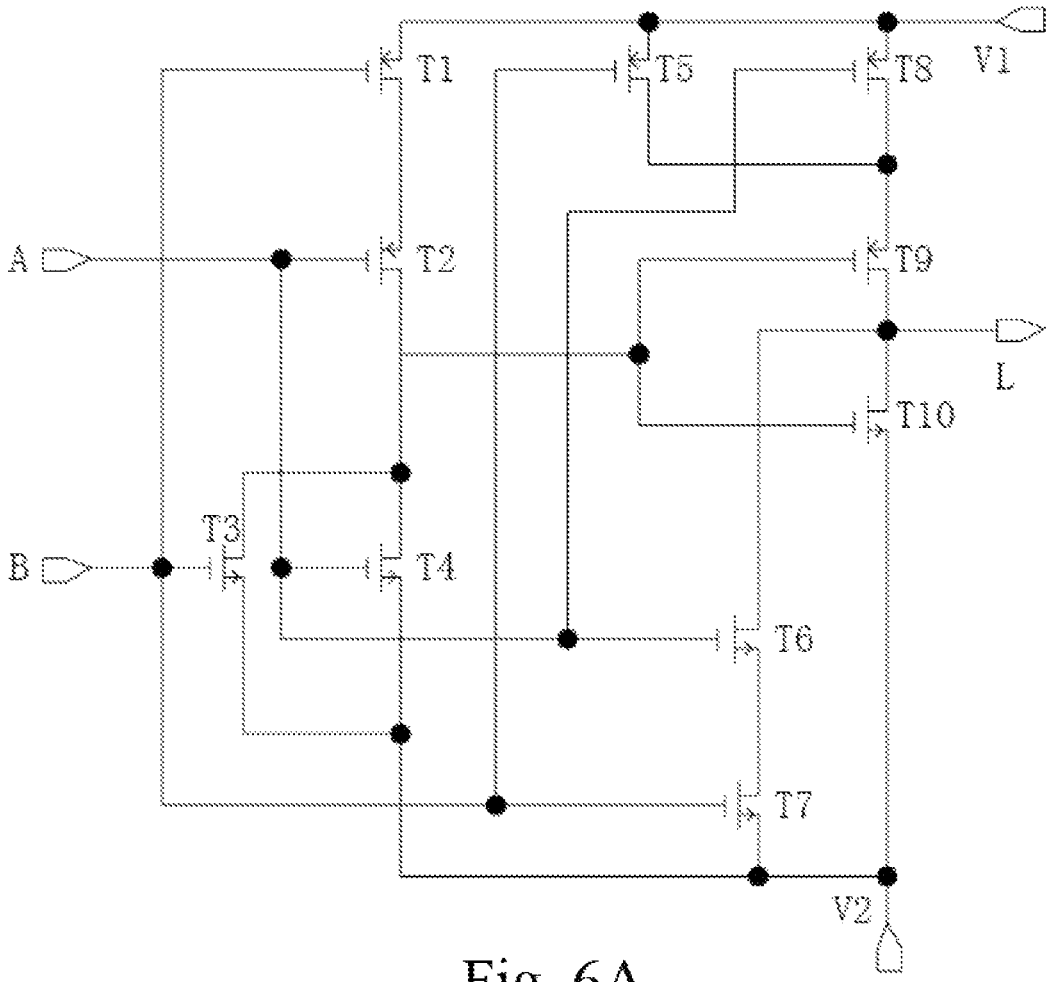
FIG. 6A is a schematic view illustrating the structure of an output enable signal driving circuit according to an embodiment of the disclosure.
FIG. 6B shows a truth table of gate-level logic circuit according to an embodiment of the disclosure.

Furthermore, the output enable signal driving circuit 33 includes a first input end A, a second input end B, a first voltage signal line V1, a second voltage signal line V2 and an output end L, as shown in FIG. 6A. The first voltage signal line V1 is a high-level terminal and the second voltage signal line V2 is a grounding terminal.

The output enable signal driving circuit 33 is further configured to output the voltage of the first voltage signal line V1 at the output end L when both the voltage input at the first input end A and the voltage input at the second input end B are either a high level voltage or a low level voltage, and output the voltage of the second voltage signal line V2 at the output end L when one of the voltage input at the first input end A and the voltage input at the second input end B is a low level voltage while the other is a high level voltage. For example, if the signal input at the first input end A is signal A, the signal input at the first input end B is signal B, and the signal outputted at the output end L is signal L, then A=1 when the first input end A inputs a high level and A=0 when the first input end A inputs a low level; B=1 when the second input end B inputs a high level and B=0 when the second input end B inputs a low level. The output enable signal driving circuit 33 subjects the signals A and B to exclusive-or operation represented by the following formulation:

$$L=\overline{A}B+A\overline{B}=A\oplus B$$

Figure 6C:
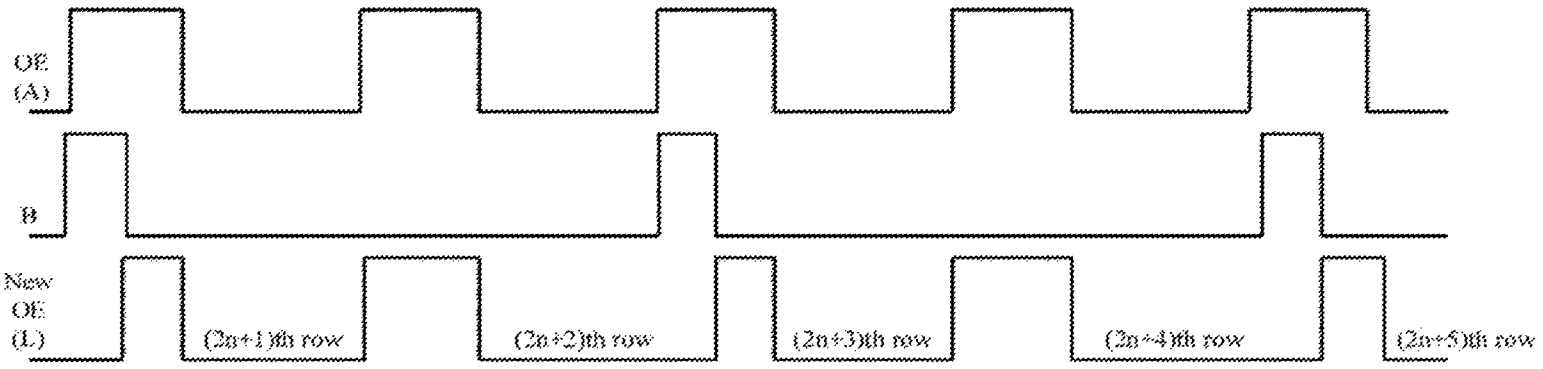
FIG. 6C is a schematic view illustrating the sequence diagram of a circuit according to an embodiment of the disclosure.

The truth table resulted from the exclusive-or operation of signals A and B is shown in FIG. 6B. As shown in FIG. 6C, a new enable signal (New OE) is obtained after a signal L is outputted from the output end of the output enable signal driving circuit 33. The V-line phenomenon can be overcome by the new enable signal.

Further, according to the sequence diagram shown in FIG. 6C, the rising edge of the voltage A input at the first input end A is aligned with that of the voltage B input at the second input end B, the frequency of the voltage A input at the first input end A is two times of that of the voltage B input at the second input end B. Optionally, to ensure that the charging time of the pixel units when the polarity inversion occurs is the same with the charging time of the pixel units polarity inversion does not occur, the pulse width of the voltage B input at the second input end B is identical with that of the rising delay time when the polarities of the data signal are inverted.

Furthermore, the difference between the second duration and the first duration substantially matches the rising delay time when the polarities of the data signal are inverted.

Furthermore, some embodiments of the disclosure provide detailed structure of the output enable signal driving circuit 33. As shown in FIG. 6A, the output enable signal driving circuit 33 includes a first transistor T1, a second transistor T2, a third transistor T3, a fourth transistor T4, a fifth transistor T5, a sixth transistor T6, a seventh transistor T7, an eighth transistor T8, a ninth transistor T9, and a tenth transistor T10. The first transistor T1, the second transistor T2, the fifth transistor T5, the eighth transistor T8 and the ninth transistor T9 are P-type transistor, while the third transistor T3, the fourth transistor T4, the sixth transistor T6, the seventh transistor T7 and the tenth transistor T10 are N-type transistor. Of course, the transistors T1, T2, T5, T8 and T9 may be N-type transistor, while the transistors T3, T4, T6, T7 and T10 may be N-type transistor, which is not limited by embodiments of the disclosure.

It should be noted that the transistors used in the embodiments of the disclosure may be thin film transistors (TFT) or field-effect transistors or any other components having the similar properties. According to the function of the transistors in the circuit, the transistors used in the embodiments of the disclosure are mainly switching transistors. With respect to the transistor, e.g., metal-oxide-semiconductor (MSO) transistor as used in the embodiments of the disclosure, its control end represents the gate, its first end represents the source, and its second end represents the drain.

In one embodiment, as shown in FIG. 6A, a first end of the first transistor T1 is connected to the first voltage signal line V1, a second end of the first transistor T1 is connected to a first end of the second transistor T2, and a control end of the first transistor T1 is connected to the second input end B. A second end of the second transistor T2 is connected to a first end of the third transistor T3 and a first end of the fourth transistor T4, respectively, and a control end of the second transistor T2 is connected to the first input end A. A first end of the fifth transistor T5 is connected to the first voltage signal line V1, a second end of the fifth transistor T5 is connected to a second end of the eighth transistor T8 and a first end of the ninth transistor T9, respectively, and control end of the fifth transistor T5 is connected to the second input end B. A first end of the eighth transistor T8 is connected to the first voltage signal line V1, a second end of the eighth transistor T8 is connected to a first end of the ninth transistor T9, and a control end of the eighth transistor T8 is connected to the first input end A. A second end of the ninth transistor T9 is connected to the output end L, and a control end of the ninth transistor T9 is connected to a control end of the tenth transistor.

Optionally, a second end of the third transistor T3 is connected to the second voltage signal line V2, and a control end of the third transistor T3 is connected to the second input end B. A second end of the fourth transistor T4 is connected to the second voltage signal line V2, and a control end of the fourth transistor T4 is connected to the first input end A. A first end of the sixth transistor T6 is connected to the output end L, a second end of the sixth transistor T6 is connected to a first end of the seventh transistor T7, and a control end of the sixth transistor T6 is connected to the first input end A. A second end of the seventh transistor T7 is connected to the second voltage signal line V2, and a control end of the seventh transistor T7 is connected to the second input end B. A first end of the tenth transistor T10 is connected to the output end L, a second end of the tenth transistor T10 is connected to the second voltage signal line V2, and a control end of the tenth transistor T10 is connected to a second end of the second transistor T2. The output end L is connected to the output enable signal The working principle of the output enable signal driving circuit will be described in the following. As an example, the first voltage signal line V1 is considered as a high-level terminal and the second voltage signal line V2 is considered as a grounding terminal.

In the case that both the first input end A and the second input end B input a high level, the N-type transistors the gates of which are directly connected to the first input end A or the second input end B are turned on, and the P-type transistors the gates of which are directly connected to the first input end A or the second input end B are cut off. In other words, the transistors T3, T4, T6 and T7 are turned on and the transistors T1, T2, T5 and T8 are cut off. The sources of the transistors T9 and T10 are connected between the second end of the transistor T2 and the first end of the transistor T4, the sources of both the transistors T9 and T10 are connected to the second voltage signal line V2 via the transistor T4, therefore, the gates of the transistors T9 and T10 are at a low level. Accordingly, the transistor T9 is turned on and the transistor T10 is cut off. Since the transistor T9 has no signal input, the output end L is at a low level. In other words, when A=1 and B=1, L=0.

In the case that both the first input end A and the second input end B input a low level, the transistors T1, T2, T5 and T8 are turned on and the transistors T3, T4, T6 and T7 are cut off. The gates of the transistors T9 and T10 are connected to the first voltage signal line V1 via the transistors T1 and T2, therefore the gates of the transistors T9 and T10 are at a high level, the transistor T9 is cut off and the transistor T10 is turned on. The second voltage signal line V2 is connected to the output end L via the transistor T10, therefore the output end L is at a low level, i.e., when A=0 and B=0, L=0.

In the case that the first input end A inputs a high level and the second input end B inputs a low level, the transistors T1 and T5 are turned on and the transistors T2, T3, T4, T6, T7 and T8 are cut off. The gates of the transistors T9 and T10 are at a low level, the transistor T9 is turned on and the transistor T10 is cut off. The first voltage signal line V1 is connected to the output end L via the transistors T5 and T9, therefore the output end L is at a high level, i.e., when A=1 and B=0, L=1.

In the case that the first input end A inputs a low level and the second input end B inputs a high level, the transistors T2, T3, T7 and T8 are turned on and the transistors T1, T4, T5 and T6 are cut off. The gates of the transistors T9 and T10 are connected to the second voltage signal line V2 via the transistor T3, therefore the gates of the transistors T9 and T10 are at a low level, the transistor T9 is turned on and the transistor T10 is cut off. The first voltage signal line V1 is connected to the output end L via the transistors T8 and T9, therefore the output end L is at a high level, i.e., when A=0 and B=1, L=1.

The driving apparatus according to an embodiment of the disclosure is configured to input a voltage signal having a first duration to the output enable signal line if the polarities of the data signal are inverted during a first scan cycle, and input a voltage signal having a second duration longer than the first duration to the output enable signal line if the polarities of the data signal are not inverted during a second scan cycle, whereby the turn-on duration of the corresponding gate lines is adjusted when the polarities of the data signal are inverted. As a result, the charging time of the pixel units when the polarities of the data signal are inverted substantially matches charging time of the pixel units when the polarities of the data signal are not inverted, avoiding the occurrence of V-line phenomenon and ensuring even brightness of both the left and right pixel units.

An embodiment of the disclosure further provides a display apparatus including the driving apparatus described in relation to the previous embodiments. Such display apparatus may be any product or component having display function, such as a mobile phone, a tablet, a TV, a display, a laptop, a digital photo frame, a navigator, or the like, which is not limited by the embodiments of the disclosure.

The display apparatus according to an embodiment of the disclosure is configured to input a voltage signal having a first duration to the output enable signal line if the polarities of the data signal are inverted during a first scan cycle, and input a voltage signal having a second duration longer than the first duration to the output enable signal line if the polarities of the data signal are not inverted during a second scan cycle, whereby the turn-on duration of the corresponding gate lines is adjusted when the polarities of the data signal are inverted. As a result, the charging time of the pixel units when the polarities of the data signal are inverted substantially matches the charging time of the pixel units when the polarities of the data signal are not inverted, avoiding the occurrence of V-line phenomenon and ensuring even brightness of both the left and right pixel units.

Figure 7:
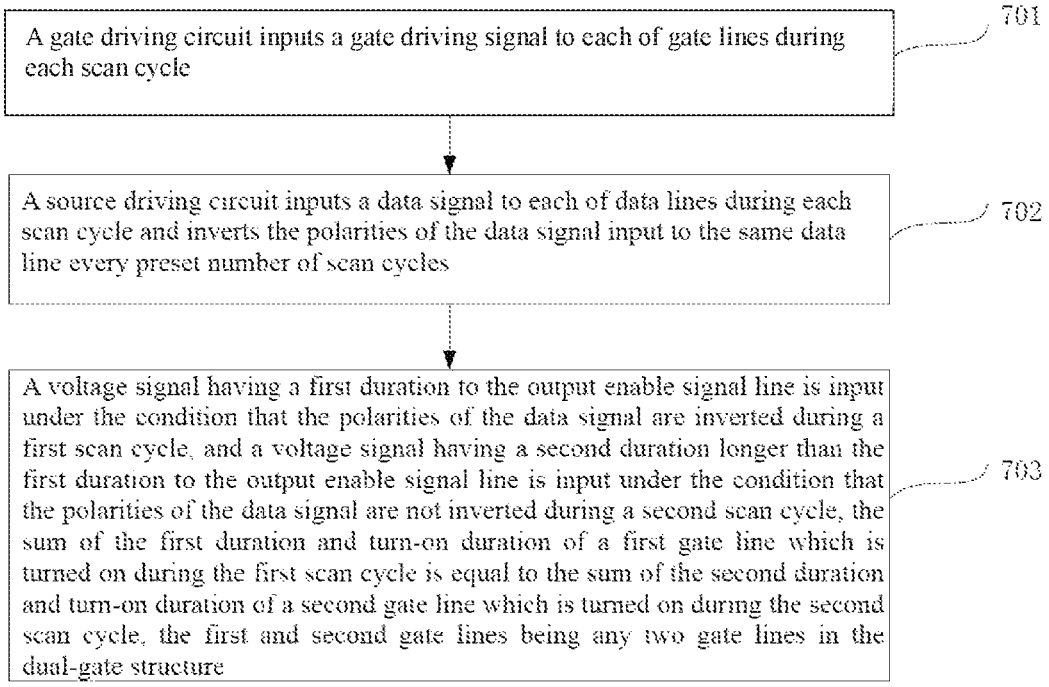
FIG. 7 is a schematic view illustrating the flow chart of a driving method according to an embodiment of the disclosure.

FIG. 7 is a flow chart of a driving method for use in the above described driving apparatus according to an embodiment of the disclosure.

At 701, a gate driving circuit inputs a gate driving signal to each of gate lines during each scan cycle.

At 702, a source driving circuit inputs a data signal to each of data lines during each scan cycle and inverts the polarities of the data signal input to the same data line every preset number of scan cycles.

At 703, input a voltage signal having a first duration to the output enable signal line in response to the condition that the polarities of the data signal are inverted during a first scan cycle, and input a voltage signal having a second duration longer than the first duration to the output enable signal line in response to the condition that the polarities of the data signal are not inverted during a second scan cycle, the sum of the first duration and turn-on duration of a first gate line which is turned on during the first scan cycle substantially matches the sum of the second duration and turn-on duration of a second gate line which is turned on during the second scan cycle, the first and second gate lines being any two gate lines in the dual-gate structure.

Optionally, to ensure that the charging time of the pixel units when the polarities of the data signal are inverted is equal to the charging time of the pixel units when the polarities of the data signal are not inverted, it is necessary that the difference between the second duration and the first duration equals to the rising delay time when the polarities of the data signal are inverted.

Optionally, the preset number of scan cycles is 2.

The method according to an embodiment of the disclosure includes inputting a voltage signal having a first duration to the output enable signal line if the polarities of the data signal are inverted during a first scan cycle, and inputting a voltage signal having a second duration longer than the first duration to the output enable signal line if the polarities of the data signal are not inverted during a second scan cycle, whereby the turn-on duration of the corresponding gate lines is adjusted during the polarity inversion of the data signal. As a result, the charging time of the pixel units when the polarities of the data signal are inverted substantially matches the charging time of the pixel units when the polarities of the data signal are not inverted, avoiding the occurrence of V-line phenomenon and ensuring even brightness of both the left and right pixel units.

Those skilled in the art would appreciate that all or a part of the steps in the foregoing embodiments may be implemented by hardware or a program instructing relevant hardware. The program may be stored in a computer readable storage medium, such as a ROM, a magnetic disk, or an optical disk etc.

The above described embodiments are not intended to limit the disclosure. Any modifications, equivalent replacement or improvement made to these embodiments without departing the sprit and scope of the disclosure shall fall into the scope of the disclosure.

What is claimed is:

1. A driving apparatus comprising a gate driving circuit, a source driving circuit and an output enable signal driving circuit, wherein:

the gate driving circuit, which is connected to each of gate lines, is configured to input a gate driving signal to one of the gate lines during each scan cycle;

the source driving circuit, which is connected to each of data lines, is configured to input a data signal to each of data lines during each scan cycle and invert the polarities of the data signal input to the same data line every preset number of scan cycles; and the output enable signal driving circuit, which is connected to an output enable signal line, is configured to input a voltage signal having a first duration to the output enable signal line in response to the condition that the polarities of the data signal are inverted during a first scan cycle, and input a voltage signal having a second duration longer than the first duration to the output enable signal line in response to the condition that the polarities of the data signal are not inverted during a second scan cycle, the sum of the first duration and the turn-on duration of a first gate line which is turned on during the first scan cycle substantially matches the sum of the second duration and the turn-on duration of a second gate line which is turned on during the second scan cycle;

wherein the first gate line is switched off at a rising edge of an output enable signal and the second gate line is turned on at a falling edge of the output enable signal;

wherein the first gate line is an odd gate line in a dual-gate structure, and the second gate line is an even gate line in the dual-gate structure;

wherein the turn-on duration of the first gate line is more than the turn-on duration of the second gate line;

wherein the turn-on duration of the first gate line is configured for all odd gate lines, and the turn-on duration of the second gate line is configured for all even gate lines; and wherein the first scan cycle is for the odd gate line, and the second scan cycle is for the even gate line.

2. The driving apparatus according to claim 1, wherein:

the output enable signal driving circuit comprises a first input end, a second input end, a first voltage signal line, a second voltage signal line and an output end; and the output enable signal driving circuit is further configured to output the voltage of the first voltage signal line at the output end when both the voltage input at the first input end and the voltage input at the second input end are either a high level voltage or a low level voltage, and output the voltage of the second voltage signal line at the output end when one of the voltage input at the first input end and the voltage input at the second input end is a low level voltage while the other is a high level voltage.

3. The driving apparatus according to claim 2, wherein the rising edge of the voltage input at the first input end is aligned with the rising edge of the voltage input at the second input end, and the frequency of the voltage input at the first input end is two times of the frequency of the voltage input at the second input end.

4. A display apparatus comprising the driving apparatus according to claim 3.

5. A driving method for use in the driving apparatus according to claim 3, comprising:

inputting a gate driving signal to each of gate lines during each scan cycle by a gate driving circuit;

inputting a data signal to each of data lines during each scan cycle and inverting the polarities of the data signal input to the same data line every preset number of scan cycles by a source driving circuit; and inputting a voltage signal having a first duration to the output enable signal line in response to the condition that the polarities of the data signal are inverted during a first scan cycle, and inputting a voltage signal having a second duration longer than the first duration to the output enable signal line in response to the condition that the polarities of the data signal are not inverted during a second scan cycle, the sum of the first duration and turn-on duration of a first gate line which is turned on during the first scan cycle substantially matches the sum of the second duration and turn-on duration of a second gate line which is turned on during the second scan cycle, the first and second gate lines being any two gate lines in the dual-gate structure.

6. The driving apparatus according to claim 2, wherein the pulse width of the voltage input at the second input end substantially matches the rising delay time when the polarities of the data signal are inverted.

7. A display apparatus comprising the driving apparatus according to claim 6.

8. A driving method for use in the driving apparatus according to claim 6, comprising:

inputting a gate driving signal to each of gate lines during each scan cycle by a gate driving circuit;

inputting a data signal to each of data lines during each scan cycle and inverting the polarities of the data signal input to the same data line every preset number of scan cycles by a source driving circuit; and inputting a voltage signal having a first duration to the output enable signal line in response to the condition that the polarities of the data signal are inverted during a first scan cycle, and inputting a voltage signal having a second duration longer than the first duration to the output enable signal line in response to the condition that the polarities of the data signal are not inverted during a second scan cycle, the sum of the first duration and turn-on duration of a first gate line which is turned on during the first scan cycle substantially matches the sum of the second duration and turn-on duration of a second gate line which is turned on during the second scan cycle, the first and second gate lines being any two gate lines in the dual-gate structure.

9. The driving apparatus according to claim 2, wherein the output enable signal driving circuit comprises a first transistor, a second transistor, a third transistor, a fourth transistor, a fifth transistor, a sixth transistor, a seventh transistor, an eighth transistor, a ninth transistor, and a tenth transistor, each of the first, second, fifth, eighth and ninth transistors is a P-type transistor; and each of the third, fourth, sixth, seventh and tenth transistors is an N-type transistor.

10. The driving apparatus according to claim 9, wherein:

a first end of the first transistor is connected to the first voltage signal line, a second end of the first transistor is connected to a first end of the second transistor, and a control end of the first transistor is connected to the second input end;

a second end of the second transistor is connected to a first end of the third transistor and a first end of the fourth transistor, and a control end of the second transistor is connected to the first input end;

a first end of the fifth transistor is connected to the first voltage signal line, a second end of the fifth transistor is connected to a second end of the eighth transistor and a first end of the ninth transistor, respectively, and a control end of the fifth transistor is connected to the second input end;

a first end of the eighth transistor is connected to the first voltage signal line, a second end of the eighth transistor is connected to a first end of the ninth transistor, and a control end of the eighth transistor is connected to the first input end; and a second end of the ninth transistor is connected to the output end, and a control end of the ninth transistor is connected to a control end of the tenth transistor.

11. The driving apparatus according to claim 9, wherein:

a second end of the third transistor is connected to the second voltage signal line, and a control end of the third transistor is connected to the second input end;

a second end of the fourth transistor is connected to the second voltage signal line, and a control end of the fourth transistor is connected to the first input end;

a first end of the sixth transistor is connected to the output end, a second end of the sixth transistor is connected to a first end of the seventh transistor, and a control end of the sixth transistor is connected to the first input end;

a second end of the seventh transistor is connected to the second voltage signal line, and a control end of the seventh transistor is connected to the second input end; and a first end of the tenth transistor is connected to the output end, a second end of the tenth transistor is connected to the second voltage signal line, and a control end of the tenth transistor is connected to a second end of the second transistor.

12. The driving apparatus according to claim 2, wherein the output end is connected to the output enable signal line.

13. A display apparatus comprising the driving apparatus according to claim 2.

14. A driving method for use in the driving apparatus according to claim 2, comprising:

inputting a gate driving signal to each of gate lines during each scan cycle by a gate driving circuit;

inputting a data signal to each of data lines during each scan cycle and inverting the polarities of the data signal input to the same data line every preset number of scan cycles by a source driving circuit; and inputting a voltage signal having a first duration to the output enable signal line in response to the condition that the polarities of the data signal are inverted during a first scan cycle, and inputting a voltage signal having a second duration longer than the first duration to the output enable signal line in response to the condition that the polarities of the data signal are not inverted during a second scan cycle, the sum of the first duration and turn-on duration of a first gate line which is turned on during the first scan cycle substantially matches to the sum of the second duration and turn-on duration of a second gate line which is turned on during the second scan cycle, the first and second gate lines being any two gate lines in the dual-gate structure.

15. The driving apparatus according to claim 1, wherein the time difference between the second duration and the first duration substantially matches the rising delay time when the polarities of the data signal are inverted.

16. The driving apparatus according to claim 1, wherein the preset number of scan cycles is 2.

17. A display apparatus comprising the driving apparatus according to claim 1.

18. A driving method for use in the driving apparatus according to claim 1, comprising:

inputting a gate driving signal to one of gate lines during each scan cycle by a gate driving circuit;

inputting a data signal to each of data lines during each scan cycle and inverting the polarities of the data signal input to the same data line every preset number of scan cycles by a source driving circuit; and inputting a voltage signal having a first duration to the output enable signal line in response to the condition that the polarities of the data signal are inverted during a first scan cycle, and inputting a voltage signal having a second duration longer than the first duration to the output enable signal line in response to the condition that the polarities of the data signal are not inverted during a second scan cycle, the sum of the first duration and turn-on duration of a first gate line which is turned on during the first scan cycle substantially matches the sum of the second duration and turn-on duration of a second gate line which is turned on during the second scan cycle, the first and second gate lines being any two gate lines in the dual-gate structure.

19. The driving method according to claim 18, wherein the time difference between the second duration and the first duration substantially matches the rising delay time when the polarities of the data signal are inverted.

20. The driving method according to claim 18, wherein the preset number of scan cycles is 2.

* * * * *